United States Patent [19]

Baumrind

[11] 3,955,789

[45] May 11, 1976

[54] TUBE HOLDER

[75] Inventor: Stephen J. Baumrind, Charleston, S.C.

[73] Assignee: Larry Harold Kline, Charleston, S.C. ; a part interest

[22] Filed: Nov. 16, 1972

[21] Appl. No.: 307,028

Related U.S. Application Data

[62] Division of Ser. No. 214,186, Dec. 30, 1971, Pat. No. 3,737,921.

[52] U.S. Cl. ..... 248/311 A; 211/71; 222/185

[51] Int. Cl.[2] ..... A47C 7/70; A61G 12/00; A47B 73/00

[58] Field of Search ..... 248/205 R, 311, 312, 248/309, 108, 109; 222/105, 93, 100, 180, 185; 211/71

[56] References Cited

UNITED STATES PATENTS

| | | | |
|---|---|---|---|
| 1,760,945 | 6/1930 | Grigsby | 222/105 |
| 2,567,629 | 9/1951 | Veon et al. | 222/105 UX |
| 2,613,853 | 10/1952 | Halvorsen | 222/105 UX |
| 2,660,339 | 11/1953 | Koob | 222/105 |
| 3,037,673 | 6/1962 | Tornquist | 222/185 |
| 3,101,869 | 8/1963 | Baker | 222/105 |
| 3,285,558 | 11/1966 | Dobrin | 248/309 |
| 3,346,228 | 10/1967 | Thorman | 248/316 A |
| 3,615,046 | 10/1971 | Bashara | 248/126 X |

*Primary Examiner*—J. Franklin Foss
*Attorney, Agent, or Firm*—Larry Harold Kline

[57] ABSTRACT

A splash-guard is disclosed which may be either permanent or portable, which contains storage means and hanging means, and which may be effectively used on any corner of a bathtub.

4 Claims, 8 Drawing Figures

TUBE HOLDER

This is a division of application Ser. No. 214,186, filed Dec. 30, 1971, now U.S. Pat. No. 3,737,921.

This invention relates to a shower-bath construction and, more particularly to a splash-guard, which can be either permanently or temporarily attached and which contains compartments and which is adaptable for use on any side of the bathtub.

In a bathroom where both a bathtub and a shower attachment are present, a curtain or a bathtub door arrangement is usually provided above the tub to prevent water discharge from the overhead shower nozzle onto the floor of a room. The lower end of the curtain, if used, extends downward into the tub in order to prevent water from dripping from the curtain onto the floor. No provision had been made to prevent water from striking the walls and splashing past side edges of the curtain onto the floor until Sternbergh in his U.S. Pat. No. 1,807,107, patented May 26, 1931, came up with a combination splash-guard and tile for forming the same. The splash-guard should effectively prevent water from splashing past the side edges of the curtain.

Sternbergh's splash-guard is of a permanent type, being made of tile, and also served as a hand-hold for help, in stepping in and out of the tub. Sternbergh in no way teaches a portable splash-guard; storage means combined with a splash-guard; a removable, reversible splash-guard; hooks or clothes lines combined with a splash-guard; or a dual purpose compartments and hangers. These features are all contained in the present application.

An object of the present invention is to provide a splash-guard which can perform the dual capability of being either permanently or temporarily attached to the wall of a room containing a shower-bath arrangement.

Another object of this invention is to provide a device including a splash-guard which also comprises a multiplicity of compartments for storage purposes.

Still another object of this invention is to provide a storage area accessible from the bathtub, which can provide both wet and dry storage.

Another object of this invention is to provide a portable splash-guard which can be used on any side of the bathtub.

Another object of this invention is to provide hanging means combined with a splash-guard.

Another object of this invention is to provide compartments for storage that will allow any water which will land in said compartments to flow into the bathtub.

Another object of this invention is to provide a special compartment for holding tubes such as shampoo tubes.

These and other objects and features of the invention will be apparent from the following description and appended claims.

Briefly, the invention is a device for use with a shower bath arrangement, which contains a bathtub and shower attachment. A splash-guard is provided to help prevent water from said shower attachment from escaping from said bathtub. Said splash-guard has the dual capability of being either permanently or temporarily attached to the wall of the room containing the shower-bath arrangement. A multiplicity of compartments for storage purposes may be contained within the device. The compartments for storage purposes include compartments for either wet or dry storage and also include special compartments for holding shampoo. The device also may be used on any corner of the bathtub.

The invention will be more fully understood from the following detailed description and appended claims when taking with the drawings in which:

Figure 1:
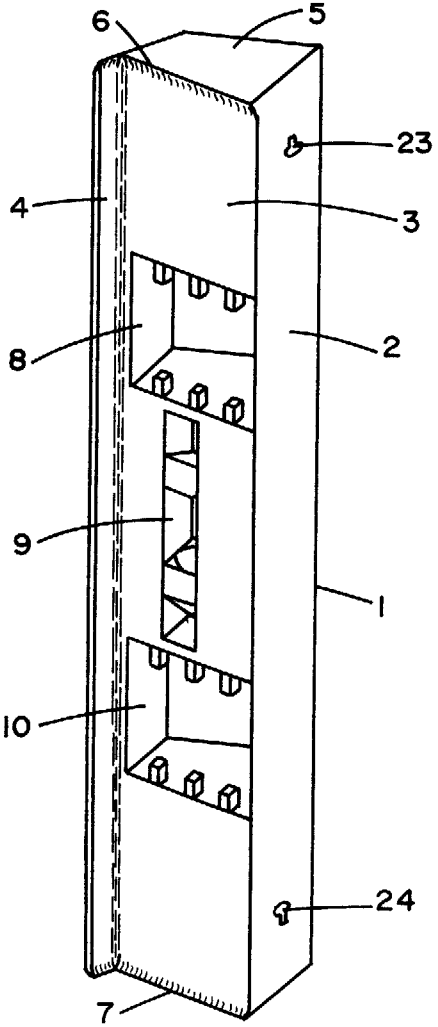
FIG. 1 is a trisometric view of the device as it would be placed against the wall, seen between the bath side and wall side.

Referring now to the drawings, FIG. 1 shows a water blocking device 1. This water blocking device 1 has many purposes. Device 1 contains a wall side 2, a bath side 3, a blocking edge 4, upper and lower edges 6 and 7, and top and bottom sides 5 and 11.

Voids 23 and 24 on wall side 2 provide a method for attaching device 1 to the wall. A screwhead or nailhead may be used to be placed into the wall. The larger area of voids 23 and 24 will fit over this screwhead or nailhead, which will then be lowered down to the smaller circumference of voids 23 and 24, thereby providing support for water blocking device 1 onto the wall. The method for attaching device 1 to the wall may also be made temporary. One method for making it temporary would be attaching a two-sided adhesive tape, with one side on wall side 2 and the other side pressed firmly against the wall, thereby supporting water blocking device 1. Water blocking device 1 is placed against the wall and may be used along with a curtain or a bathtub door arrangement to prevent water discharge from an overhead shower nozzle onto the floor of a room. Water blocking device 1 prevents the water from escaping past the ends of the curtain and also from the ends of a bathtub door arrangement.

Due to the capability of being able to permanently attach the water blocking device 1 to the wall by means herein described, or by attaching water blocking device 1 to the wall by adhesive removable means, this invention provides a splash-guard which performs the dual capability of being either permanently or temporarily attached to the room containing a shower bath arrangement.

FIG. 1 also shows compartment for storage purposes 8, holding means for tubes 9, and another compartment for storage purposes 10. The top side 5 of the device is also shown in FIG. 1.

Figure 2:
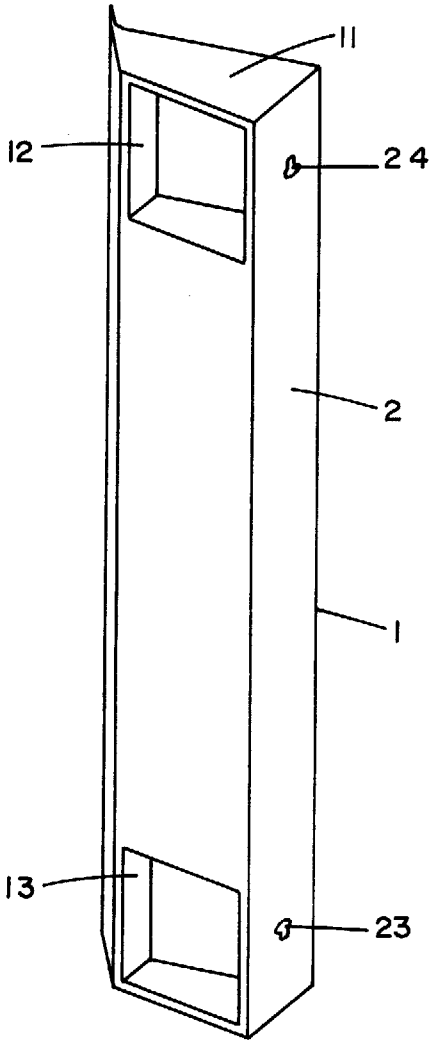
FIG. 2 is a view of the same device as in FIG. 1, the device having been turned over and viewed from the room outside the bathtub.

FIG. 2 shows the water blocking device 1, of FIG. 1 turned over and viewed from the room outside the bathtub. Turned over means that the device 1 is turned 180°, whereas top 5 would then become the bottom side of water blocking device 1. Bottom side 11 would then become the new top side.

The lower curved edge 7 in FIG. 1 slopes down, allowing any water from the shower attachment which lands on water blocking device 1 to be deposited in the bathtub. The upper curved edge 6 is sloped in a manner that when the water blocking device 1 is turned over i.e., rotated 180°, the upper edge 6 then becomes the new bottom edge and is sloped downward, and allows any water from the shower attachment which might fall on the water blocking device 1 to flow into the bathtub.

The design of water blocking device 1 is such that when it is turned over the wall side 2 will still be pressed against the wall, but the bottom side 11 and the top side 5 will be reversed. The beauty of this design is that only one water blocking device 1 need be manufactured, and it will be effective for use on any outside corner of the bathtub to prevent water from reaching the outside floor. This device can also be used from the inner corners of the bathtub if only the storage aspects, which will be discussed herein, are desired.

Compartments 8 and 10 have been designed so that they will be equally effective for storage purposes, if the device is rotated 180°.

Figure 5:
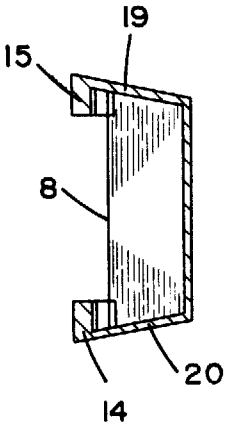
FIG. 5 is a side view of the compartment for storage purposes taken at points A—A′ of FIG. 3.
Figure 4:
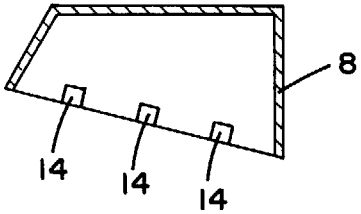
FIG. 4 is a top view of a compartment for storage purposes, taken at points D—D′.
Figure 3:
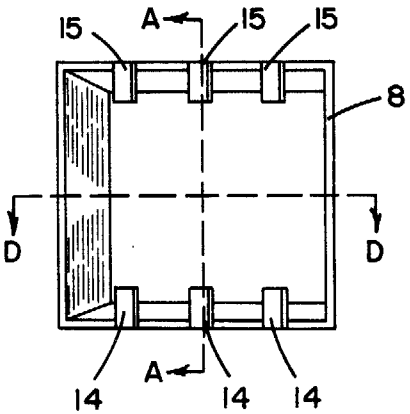
FIG. 3 is a view of the compartment for storage purposes as viewed from the bath side of the device.

FIG. 3, FIG. 4 and FIG. 5 all show compartment 8 for storage purposes in greater detail. FIG. 3 showing the compartment from the bath side view. FIG. 4 from the top view, FIG. 5 from a sectional view taken at points A—A' of FIG. 3. FIG. 3 shows bottom flanges 14 and top flanges 15. A multiplicity of flanges 14 and 15 may be used, the actual number depending on the desire of the designer.

Compartment 8 for storage purposes comprises a top layer 19, sloped upward from the back to the front of the compartment, so that when the device is turned 180° the top layer 19 becomes the new bottom layer. Water which lands on device 1 will flow to the new bottom layer and into the bathtub.

Compartment 8 has a bottom layer 20 sloped downward from the back to the front of the compartment, thereby allowing any water from the shower attachment which might enter compartment 8 to leave the compartment 8 and flow down the bottom layer 20 into the bathtub. Flanges 14 rise from the front of compartment 8 preventing any objects stored in compartment 8 from escaping due to the slope of bottom layer 20. Top flanges 15 emanate from the top of compartment 8. When device 1 is turned 180°, the top flanges 15 become the new bottom flanges, and prevent any objects stored in compartment 8 from escaping due to the slope of the new bottom layer 19. Bottom flanges 14 can also be used as hooks for hanging objects. Top flanges 15 when the device 1 is rotated 180°, also may in the same manner be used for hooks for hanging objects. When two of the devices 1 are used on opposite ends of a bathtub, a connecting means such as wire or string, or any other type of connecting means may be connected to one or more hooks or flanges 14 and 15 on one device 1 and connected to one or more hooks or flanges 14 or 15 on the other device 1 so that articles may be placed thereon. This may act as a clothesline. This is another advantage and feature of this invention.

The compartments therefore have a dual purpose, and serve not only to store goods, but to hang objects thereon and hang connecting means thereon to form a clothesline.

Figure 8:
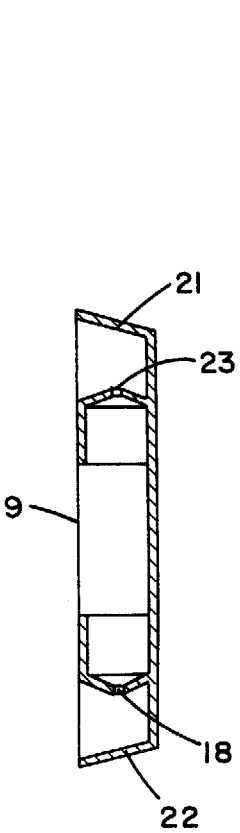
FIG. 8 is a side view of the tube holding means taken at the points C—C′ of FIG. 6.
Figure 7:
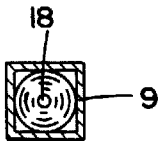
FIG. 7 is a top view taken of the tube holding means at the points B—B′ of FIG. 6.
Figure 6:
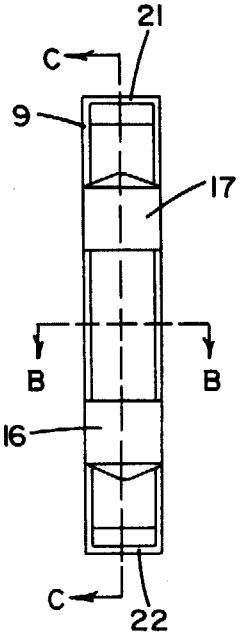
FIG. 6 is a view from the bath side of the device of the tube holding means.

FIG. 6, FIG. 7 and FIG. 8 show a compartment 9 for holding tubes. This compartment 9 allows access for squeezing the tubes and access for receiving the contents of the tubes when squeezed. The compartment 9 for holding tube comprises a bottom molded support 16 and a top molded support 17. Bottom molded support 16 has an opening 18. Top molded support 17 has an opening 23.

A tube may be placed in bottom molded support 16. The nozzle of the tube rests in opening 18. The bather who wishes to shampoo simply unscrews the cap of the tube and places it in Support 16. He then has access to the shampoo and will know at all times where the shampoo tube is located. He will be able to get as much shampoo as required. A cap attachment could be added to the tube holder which would simply be placed onto the end of the tube when it is being held in the holding means 9. However, in most cases shampoo will not run out of a tube without squeezing. The bather places his hand below the bottom molded support 16 and presses the section of the tube above the bottom support 16. The shampoo will be forced through the nozzle and into the hand of the bather.

Compartment 9 is a holding means for tubes and has a sloped bottom layer 22. Any water landing within compartment 9, will flow to bottom layer 22 which is sloped, and will therefore flow into the bathtub. When water blocking device 1 is rotated 180°, the tube will be placed in uppr molded support 17 which will be the new lower molded support, the nozzle of the tube will then be in opening 23. The bather will then procure his shampoo in the same manner previously described. Top layer 21 of the tube holder will then become the new bottom layer. It also is sloped so that any water that lands within the holding tubes 9 will flow into the bathtub.

Outer storage compartments 12 and 13 may be used to keep articles stored and also dry. Since compartments 12 and 13 are on the outside of the bathtub, they will not be sprayed by water from the shower attachment.

The water blocking device 1 serves as water blocking means. Compartments 8 and 10 serve as storage means which may be wet due to the spray from the shower attachment. Compartments 12 and 13 serve as means for dry storage. These compartments 8, 10, 12 and 13 fulfill an object of the invention which was to provide both wet and dry storage.

The water blocking device 1 can be made out of a molded plastic, stainless steel, or any other type of material which might be available. Molded plastic is recommended as inexpensive to produce this device. Molded plastic also will make device 1 easily portable and easily cleanable. A clear molded plastic also has the advantage in that materials stored in outer compartments 12 and 13 would be visible to the bather. One suggested use of compartments 12 and 13 would be storage of a clock, by which a bather could know the exact time from within the bathtub.

Water blocking device 1 enables anything you need in the bathtub area to be easily available to you. Items are stored between the tub and the rest of the bathroom.

The invention can be permanently attached; however, it has the advantage of also being temporary and removable. It is easily removable for cleaning purposes and can also be moved from apartment-to-apartment or bathroom-to-bathroom by the owner.

This device offers the advantage of easy installation by use of two-sided tape, one side attached on wall side 2 and the other side attached to the wall, to support device 1. Device 1 can also be supported by screwheads or nailheads inbedded in voids 23 and 24 as previously discussed. Device 1 acts as a splash-guard to prevent water from reaching the floor of the bathroom, between either a curtain or shower door and the wall. Device 1 offers utility space for storing such items as soap, bubble bath, bath salts, shampoo, shampoo massagers, razors, shaving soap and shaving mugs.

Toys for children may be stored in the compartments. A clock may be kept in the dry compartments to keep the bather aware of the time. This device offers hooks for wash cloths, wash brushes and shower caps, or whatever else may be desired to be hung by the bather. A mirror for shaving may also be hung. By connecting the hooks on one device to hooks on another device, a clothes line or other hanging means can be assembled for drying or any other purpose desired. Device 1 is also extremely inexpensive and can fit inside of a shower curtain or any kind of shower door. Device 1 can be made to any height convenient to the maximum height of the room involved. The compartments may be made to any specifications within the physical limits of the device. Other types of specialized compartments could be added to the device. Other methods such as hooks and permanent glue could be used to attach the device to the wall.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A device for holding a tube comprising holding means attached to a wall which allows access for squeezing said tube and access for receiving the contents of said tube when it has been squeezed and liquid removal means for liquid to flow out of said holding means, said liquid removal means comprising a bottom layer sloped downward from the back to the front of said device, thereby allowing any liquid which might enter said device to flow down said bottom layer and out of said device, wherein said liquid removal means further comprises a top layer sloped upward from the back to the front of said device, wherein said liquid removal means further comprises a top layer sloped upward from the back to the front of said device, whereby when said device is turned 180°, said top layer becomes the new bottom layer allowing any liquid which might enter said device to flow down said bottom layer and out of said device.

2. A device according to claim 1 wherein said holding means further comprises a support containing an opening, through which the nozzle of said tube extends and in which said holding means further comprises a second support containing an opening, whereby when said device is turned 180°, said tube may be held by said second support.

3. A device according to claim 2 in which said device is capable of being permanent or mobile in its attachment to the wall.

4. A device according to claim 2 in which said second support is conical.

* * * * *